United States Patent [19]

Müller

[11] 4,258,909

[45] Mar. 31, 1981

[54] APPARATUS FOR CONVERTING A STREAM OF PARTLY OVERLAPPING SHEETS INTO A ROW OF OVERLAPPING SHEETS

[75] Inventor: Hans Müller, Zofingen, Switzerland

[73] Assignee: Grapha-Holding AG, Hergiswil, Switzerland

[21] Appl. No.: 880,604

[22] Filed: Feb. 23, 1978

[30] Foreign Application Priority Data

Feb. 25, 1977 [CH] Switzerland ..... 2363/77

[51] Int. Cl.[3] ..... B65H 29/44

[52] U.S. Cl. ..... 271/181; 271/214; 414/108

[58] Field of Search ..... 271/181, 180, 214, 177, 271/69, 70, 178; 214/7; 198/457; 414/108, 106

[56] References Cited

U.S. PATENT DOCUMENTS

| | | | |
|---|---|---|---|
| 1,701,943 | 2/1929 | Barber | 271/181 |
| 2,307,822 | 1/1943 | Clegg | 271/181 |
| 3,111,312 | 11/1963 | Swanson et al. | 271/181 |
| 3,188,082 | 6/1965 | Stobb | 271/181 |

FOREIGN PATENT DOCUMENTS

| | | | |
|---|---|---|---|
| 230648 | 11/1909 | Fed. Rep. of Germany | 271/181 |
| 635787 | 11/1934 | Fed. Rep. of Germany | 271/181 |
| 574861 | 4/1976 | Switzerland | 271/181 |

*Primary Examiner*—Bruce H. Stoner, Jr.
*Attorney, Agent, or Firm*—Peter K. Kontler

[57] ABSTRACT

Apparatus for the conversion of a stream of partly overlapping sheets into a row of fully overlapping sheets has a first conveyor which transports a growing row of sheets at right angles to the planes of the sheets, and a composite second conveyor which defines a downwardly extending path wherein successive sheets of the stream descend onto the first conveyor to accumulate between spaced-apart distancing elements of the first conveyor. Successive sheets of the stream are engaged and pushed forwardly on the first conveyor by an oscillating pusher which, when retracted, provides room for descent of a sheet onto the first conveyor behind the rearmost sheet of the growing row. The amplitude and/or frequency and/or the end positions of the pusher are adjustable to account for variations in thickness and/or stiffness of sheets in successive streams and/or for differences in friction between the sheets and the second conveyor.

6 Claims, 3 Drawing Figures

APPARATUS FOR CONVERTING A STREAM OF PARTLY OVERLAPPING SHEETS INTO A ROW OF OVERLAPPING SHEETS

CROSS-REFERENCE TO RELATED CASES

Certain details of the apparatus of the present invention are disclosed in commonly owned copending application Ser. No. 751,738, now U.S. Pat. No. 4,172,531, filed Dec. 17, 1976 for "Method and apparatus for manipulating signatures in bookbinding machines" and in commonly owned Swiss Pat. No. 574,861.

BACKGROUND OF THE INVENTION

The present invention relates to apparatus for manipulating sheets, such as signatures, in bookbinding and other types of machines. More particularly, the invention relates to improvements in apparatus for converting a stream of partially overlapping single sheets, folded-over sheets or stacks of sheets into a row wherein the sheets overlap or substantially overlap each other. Such apparatus are normally used for stacking of newspapers or signatures.

The copending application Ser. No. 751,738 (some matter of which is disclosed in commonly owned Swiss Pat. No. 574,861) describes and shows an apparatus wherein a set of belt conveyors advances the stream of partly overlapping sheets in a downward direction toward the upper reaches of horizontal chains whereon the sheets are converted into a growing row (horizontal stack) of overlapping sheets between distancing elements of the chain conveyors. Fully grown rows are thereupon lifted off the chain conveyors and transported to further processing stations. The application Ser. No. 751,738 further discloses a pusher which includes several fingers pivotable about an axis which extends transversely of the path of downward movement of successive sheets of the stream. The fingers serve to push successive rearmost sheets of the growing row forwardly to thus provide room for the oncoming sheets of the stream. When the fingers assume their front end positions (as considered in the direction of movement of the growing row), their lower portions extend forwardly beyond the path along which the sheets of the stream descend toward the chain conveyors.

The just described apparatus has been found to be eminently suited for conversion of a stream of partly overlapping sheets into a row of fully overlapping sheets, especially if the thickness, stiffness and smoothness of the sheets are constant or practically constant.

OBJECTS AND SUMMARY OF THE INVENTION

An object of the invention is to provide a versatile apparatus which can convert a stream of partially overlapping sheets into a row of overlapping sheets.

Another object of the invention is to provide an apparatus which can be adjusted, in one or more different ways, to insure satisfactory conversion of a stream of partly overlapping sheets into a row of fully overlapping sheets even if the thickness, stiffness and/or other characteristics (such as smoothness) of sheets which form part of a next-following stream deviate considerably from the corresponding characteristics of sheets in the preceding stream.

A further object of the invention is to provide an apparatus wherein the adjustment to insure predictable transport and conversion of successive streams into rows of sheets is simple and can be carried out in a time-saving manner.

An additional object of the invention is to provide an apparatus of the just outlined character wherein at least some of the necessary adjustments can be carried out while the apparatus is in use and without necessitating resort to special tools and/or the attendance of highly skilled workmen.

An ancillary object of the invention is to provide the apparatus with novel and improved means for adjusting the aforementioned pusher so as to enable its fingers to properly engage and displace the oncoming sheets of a stream of partially overlapping sheets regardless of th thickness, stiffness and/or surface finish of the sheets.

The invention is embodied in an apparatus for converting a stream of partly overlapping sheets into a row of substantially fully overlapping sheets which comprises first conveyor means having a sheet supporting surface movable in a predetermined direction (such surface can be defined by the horizontal upper reach or reaches of one or more endless chain conveyors), second conveyor means defining a predetermined path for the transport of sheets which form the stream to the supporting surface whereby the sheets form a growing row which accumulates on and moves with the supporting surface in the desired direction, pusher means adjacent to the supporting surface and movable back and forth in and counter to the direction of movement of the supporting surface between spaced-apart first and second end positions to move the rearmost sheet of the growing row in the direction of movement of the supporting surface during movement toward the first end position and to provide room for movement of the foremost sheet or sheets of the stream toward the supporting surface in the second end position whereby at least a portion of the pusher means extends forwardly of the path (as considered in the direction of movement of the supporting surface) when the pusher means assumes its first end position, means for moving the pusher means between the first and second end positions, and one or more means for adjusting the pusher means relative to the first and/or second conveyor means. Such adjusting means may include (a) means for changing the distance between the first and second end positions (i.e., the amplitude of the pusher means), (b) means for simultaneously shifting the first and second end positions of the pusher means in or counter to the direction of movement of the supporting surface, and/or (c) means for varying the frequency of movement of pusher means between the first and second end positions. One or more such adjustments invariably suffice to insure predictable and reproducible conversion of a stream into a row of sheets even if the thickness, stiffness and/or surface finish of sheets which form a stream differs considerably from the thickness, stiffness and/or surface finish of sheets of the preceding stream.

The novel features which are considered as characteristic of the invention are set forth in particular in the appended claims. The improved apparatus itself, however, both as to its construction and its mode of operation, together with additional features and advantages, thereof, will be best understood upon perusal of the following detailed description of certain specific embodiments with reference to the accompanying drawing.

DESCRIPTION OF THE PREFERRING EMBODIMENTS

Figure 1:
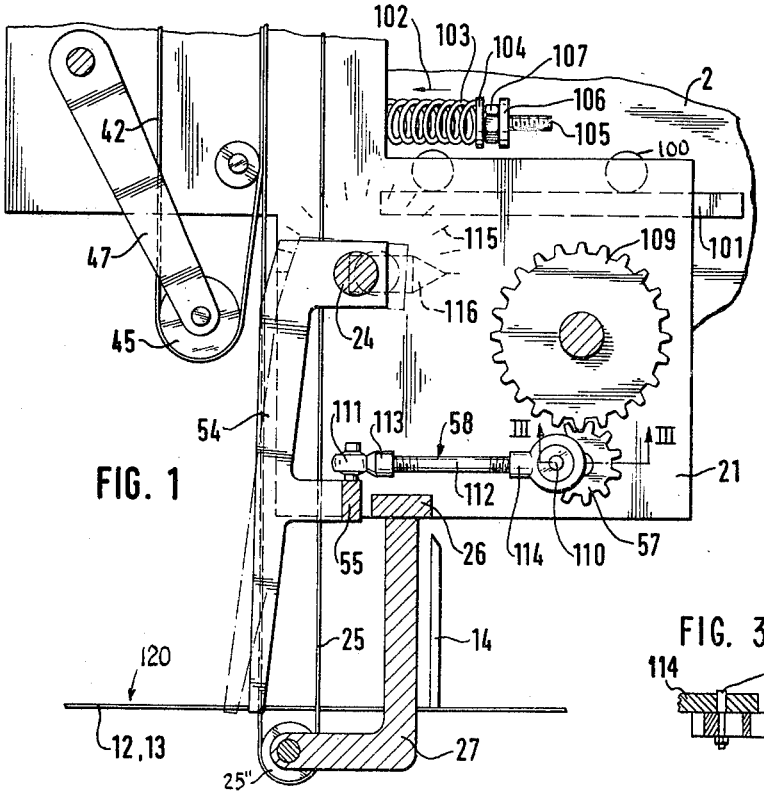
FIG. 1 is a fragmentary longitudinal vertical sectional view of an apparatus which embodies the invention.
Figure 2:
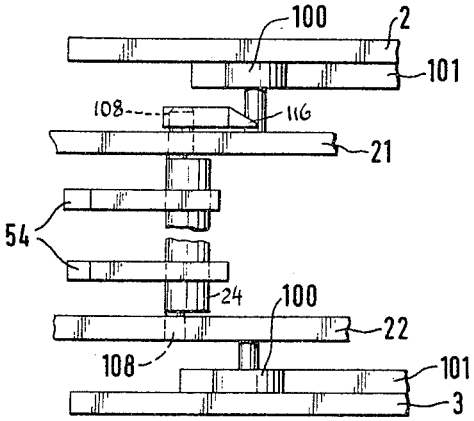
FIG. 2 is a schematic plan view of a portion of the structure which is shown in FIG. 1.

FIGS. 1 and 2 illustrate a portion of an apparatus which (save for the novel features which will be discussed hereinafter) is shown and described, in its entirety, in the commonly owned copending application Ser. No. 751,738 and which is also shown in commonly owned Swiss Pat. No. 574,861. Reference may be had to the aforesaid copending application and Swiss Patent for all such details which are not shown in the drawing of this application. For the sake of convenience, the reference characters which are employed in FIGS. 1 and 2 are identical with the reference characters denoting similar parts in the application Ser. No. 751,738.

The apparatus comprises a first conveyor which includes two endless link chains 12, 13. The upper reaches of the chains 12, 13 define a substantially horizontal supporting surface 120 for the formation of a growing row of sheets (not shown). The growing row is a horizontal stack wherein the sheets are disposed in substantially vertical planes, i.e., in planes extending at right angles to the plane of the supporting surface. The supporting surface 120 is moved in the direction indicated by arrow 102. A second conveyor of the apparatus comprises two sections or units which define a substantially vertical path along which the sheets of a stream of partly overlapping sheets move downwardly toward and are intercepted by the supporting surface 120 to thereupon move sideways in the direction by arrow 102. The first unit of the second conveyor comprises one or more endless belts 42 which are trained over one or more rollers or pulleys 45 mounted on a pivotable arm 47. The second unit of the second conveyor comprises one or more endless belts 25 which are trained over one or more rollers or pulleys 25''. The right-hand reach of the conveyor belt 42 cooperates with the left-hand reach of the conveyor belt 25 to transport the stream of partially overlapping sheets between such reaches and on toward the supporting surface 120. When the chains 12, 13 of the first conveyor assemble a fully grown row of sheets, a distancing element or spacer 14 which is carried by or moves in synchronism with the chains 12, 13 advances to a position behind the rearmost sheet of the fully grown row to prevent such sheet and the adjacent sheets from overturning while the fully grown row is advanced to a transfer station of the type shown in FIG. 1 of the copending application Ser. No. 751,738.

The arm 47 for the roller or rollers 45 is mounted on one or both plate-like bearing members 21, 22 which flank the two conveyors and which carry roller followers 100 arranged to travel forwardly or backwards (as considered in the direction indicated by arrow 102) along horizontal rails or tracks 101 secured to upright side walls 2 and 3 of the apparatus frame. The bearing members 21 and 22 are biased forwardly (i.e., in the direction indicated by arrow 102) by suitable weights (as disclosed in the aforementioned Swiss Patent) or by resorting to one or more resilient biasing elements. FIG. 1 shows a helical spring 103 which bears against a shoulder of the bearing member 21 and reacts against an adjustable retainer 104. The means for adjusting the bias of the spring 103, i.e., for moving the retainer 104 in and counter to the direction indicated by arrow 102, comprises a bolt whose shank 105 meshes with a stationary nut 106 affixed to the wall 2 and whose head 107 abuts against the rear side of the retainer. Thus, when the head 107 is rotated by resorting to a suitable tool, the retainer 104 moves in or counter to the direction indicated by arrow 102.

The arm 47 is mounted on and is normally held against pivotal movement relative to the bearing member 21. The latter is rigidly connected with the bearing member 22 by one or more crossheads 26. The crosshead 26 is further rigid with a bracket 27 which supports the roller or rollers 25'' for the belt or belts 25.

The pusher of the apparatus comprises several fingers 54 which are rigidly connected to each other by a traverse 55 and whose upper end portions are pivotable about the axis of a horizontal shaft 24 extending transversely of the path along which the sheets of the stream of partly overlapping sheets advance between the belts 42 and 25 on toward the supporting surface 120 of the chains 12, 13.

In accordance with a feature of the invention, the axis of the shaft 24 (and hence the pivot axis for the fingers 54 of the pusher) can be moved sideways to thereby simultaneously change the front and rear end positions of the lower portions of the fingers 54. The adjusting means comprises two eccentric pins or trunnions 108 which are provided at the ends of the shaft 24 and are rotatable in suitable friction or antifriction bearings provided therefor in the bearing members 21, 22 (see FIG. 2). One of the eccentric pins 108 is rigid with a pointer 116 which is accessible or observable at the outer side of the bearing member 21 (the pointer can be observed by looking through a window, not shown, in the respective side wall 2 of the frame). FIG. 1 shows that the lower end portions of the fingers 54 extend downwardly beyond the supporting surface 120 (such lower end portions of the fingers extend downwardly in the space between the chains 12 and 13 of the first conveyor).

The means for moving the lower end portions of the fingers 54 between first (front) and second (rear) end positions comprises a crank driven mounted on the bearing member 21. The crank drive includes a relatively large driver gear 109 which receives torque from the main prime mover (not shown) of the apparatus, a smaller gear 57 which meshes with the gear 109 and carries an eccentric crank pin 110, and a mechanism 58 for oscillating the fingers 54 about the axis of the shaft 24 in response to rotation of the gear 57. The mechanism 58 comprises a universal joint 111 which is mounted on the traverse 55 of the pusher, a nut 113 which is connected with the joint 111, a second nut 114 which is mounted on the crank pin 110, and a connecting rod 112 whose end portions are threaded and mesh with the nuts 113, 114. The nuts 113, 114 constitute a means for changing the effective length of the connecting rod 112.

If an attendant desires to change the frequency of oscillations of fingers 54, the step-up transmission including the gears 109, 57 is replaced with a set of gears having a different ratio. The frequency will be reduced if the gears 109, 57 are replaced with a first gear whose diameter is smaller than that of the gear 109 and with a second gear whose diameter is larger than that of the gear 57. The length of strokes which the lower end portions of fingers 54 perform during movement between first and second end positions remains unchanged as long as the distance between the axis of the pin 110 and the axis of the gear 57 (or the axis of the gear which replaces the gear 57) remains unchanged, i.e., as long as the throw of the pin 110 is constant.

The mechanism 58 constitutes a means for simultaneously shifting the first and second end positions of the fingers 54 in or counter to the direction indicated by arrow 102. Thus, the mechanism 58 can be actuated instead of changing the angular position of the shaft 24 in the bearing members 21 and 22. This will be readily appreciated since the traverse 55 is moved forwardly (in a direction to the left, as viewed in FIG. 1) if the connecting rod 112 of the mechanism 58 is rotated in a direction to move the nut 113 away from the nut 114 (i.e., to increase the effective length of 112) whereby the two end positions of the fingers 54 are shifted forwardly, as considered in the direction of movement of sheets with the supporting surface 120. Inversely, the two end positions will be shifted rearwardly if the connecting rod 112 is rotated in a direction to reduce the distance between the nuts 113 and 114, i.e., to reduce the effective length of the connecting rod 112.

The axis of the shaft 24 (i.e., the axis about which the fingers 54 of the pusher move back and forth when the gear 109 is driven) is located behind the path for the stream of partially overlapping sheets which advance between the belts 42, 25 on their way toward the supporting surface 120. Furthermore, the upper portion of the pusher 54, 55 is always located behind such path in order to insure that the foremost (lowermost) sheet or sheets of the stream can readily descend toward the chains 12 and 13. In other words, the fingers 54 cannot and should not interrupt the stream of partially overlapping sheets; their lower portions merely nudge the rearmost sheet on the supporting surface forwardly while the fingers move to their first end positions, and the lower end portions of the fingers provide room for entry of the foremost sheet or sheets of the stream behind the rearmost sheet of the growing row when the lower end portions of the fingers dwell in their second end positions. As mentioned above, the lower end portions of the fingers 54 are located ahead of the path which is defined by the belts 42, 25 when the fingers assume their first end positions. The lower end portions of the fingers 54 can push the rearmost sheet of the growing row forwardly while such sheet rests on the supporting surface 120 or even shortly before such sheet comes in contact with the upper reaches of the chains 12, 13.

The purpose of the aforediscussed adjusting means for shifting the first and second end positions of the lower finger portions in or counter to the direction indicated by arrow 102, for changing the frequency of oscillatory movements of the fingers 54 and/or for changing the distance between the first and second end positions of the fingers 54 is to enhance the versatility of the apparatus. It has been found that one, two or all three adjustments invariably insure that the fingers 54 can properly control the final stage of movement of successive sheets onto the supporting surface 120 as well as the movement of rearmost sheet of a growing row relative to the surface 120 even if the thickness, stiffness and/or surface finish of sheets which form part of a first stream of partially overlapping sheets deviates considerably from the same characteristic or characteristics of sheets which form the next-following stream or streams. The surface finish of the sheets determines the extent of friction between such sheets and the belts 42, 25 of the second conveyor as well as the extent of friction between neighboring sheets.

As explained above, the first and second end positions of the fingers 54 can be shifted in or counter to the direction of movement of the supporting surface (arrow 102) by (a) changing the angular position of the shaft 24 with respect to the bearing members 21, 22 or (b) changing the effective length of the mechanism 58 (i.e., by rotating the connecting rod 112 with respect to the nuts 113 and 114). The adjustment (a) can be readily observed by observing the position of the pointer 116 with respect to a suitably calibrated scale 115 which is applied to the outer side of the bearing member 21 and can be seen from the outside of the frame of the improved apparatus. The scale 115 further enables an attendant to return the shaft 24 to a given angular position when a stream consisting of a second type of sheets is followed by a stream consisting of a first type of sheets, namely, sheets of a (first) type which were processed in the apparatus prior to sheets of the second type. It goes without saying that the apparatus comprises suitable means for releasably holding the shaft 24 in a selected angular position.

Figure 3:
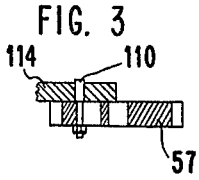
FIG. 3 is a cross-sectional view taken on line III—III of FIG. 2.

The amplitude of oscillations of the fingers 54 (i.e., the distance between the first and second end positions of the lower end portions of the fingers) can be changed by replacing the gear 57 with a gear carrying a pin 110 whose distance from the axis of the gear is different than that between the pin 110 and gear 57 of FIG. 1. Alternatively, the amplitude of oscillatory movement of the fingers 54 can be changed by adjustably mounting the pin 110 on the gear 57 so that the pin is movable radially toward and away from the axis of the gear 57 and can be held in a selected position as shown in FIG. 3. The amplitude of oscillations of the fingers 54 is increased by increasing the throw of the crank pin 110.

Finally, and as already discussed above, the frequency of oscillations of the fingers 54 can be changed by replacing the gears 109, 57 with gears having a different transmission ratio. If such replacement involves utilizing a gear 57 whose axis is nearer to or more distant from the axis of the crank pin 110, adjustment of frequency takes place simultaneously with adjustment of amplitude. It is further clear that the just discussed frequency changing means may include a suitable variable-speed transmission which receives torque from the prime mover of the apparatus (or from a separate prime mover) and drives the gear 57, either directly or via gear 109.

Experiments with the improved apparatus indicate that one or more of the aforediscussed adjustments invariably insure predictable descent of successive sheets of the stream of partly overlapping sheets onto the supporting surface of the first conveyor 12, 13, even if the characteristics of sheets forming part of successive streams vary within an extremely wide range.

Without analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for converting a stream of partly overlapping sheets into a row of substantially fully overlapping sheets, comprising first conveyor means having a sheet supporting surface movable in a predetermined direction; second conveyor means defining a predetermined path for the transport of sheets which form said stream to said supporting surface whereby such sheets form a growing row which accumulates on and moves with said supporting surface in said direction; pusher means adjacent to said supporting surface and movable back and forth in and counter to said direction between spaced-apart first and second end positions to move the rearmost sheet of the growing row in said direction during movement to said first end position and to provide room for movement of the foremost sheet of said stream toward said supporting surface in said second end position, said pusher means extending forwardly of said path, as considered in said direction, in said first end position; means for moving said pusher means between said end positions; and means for simultaneously shifting the end positions of said pusher means in and counter to said direction, including a shaft extending substantially transversely of said path and defining a pivot axis for said pusher means, and means for changing the position of said pivot axis including eccentric means provided on said shaft and bearing means rotatably supporting said eccentric means.

2. Apparatus for converting a stream of partly overlapping sheets into a row of substantially fully overlapping sheets, comprising first conveyor means having a sheet supporting surface movable in a predetermined direction; second conveyor means defining a predetermined path for the transport of sheets which form said stream to said supporting surface whereby such sheets form a growing row which accumulates on and moves with said supporting surface in said direction; pusher means adjacent to said supporting surface and movable back and forth in and counter to said direction between spaced-apart first and second end positions to move the rearmost sheet of the growing row in said direction during movement to said first end position and to provide room for movement of the foremost sheet of said stream toward said supporting surface in said second end position, said pusher means extending forwardly of said path, as considered in said direction, in said first end position; means for moving said pusher means between said end positions; and means for adapting the apparatus for handling sheets of different qualities, including means for changing the distance between said end positions, means for simultaneously shifting the end positions of said pusher means in and counter to said direction, and means for varying the frequency at which said moving means moves said pusher means between said end positions.

3. Apparatus as defined in claim 2, wherein said pusher means is pivotable between said end positions about an axis extending substantially transversely of said path and said moving means includes a crank drive having a pin and means for articulately connecting said pin to said pusher means, said distance changing means including means for changing the throw of said pin.

4. Apparatus as defined in claim 2, wherein said pusher means is pivotable between said end positions about an axis extending substantially transversely of said path, said moving means comprising a crank drive having a crank pin and a connecting rod coupling said pin to said pusher means, said shifting means including means for changing the effective length of said connecting rod.

5. Apparatus as defined in claim 2, wherein said pusher means is pivotable between said end positions about an axis extending substantially transversely of said path and said means for moving said pusher means includes a rotary crank drive, said frequency varying means including means for changing the speed of said drive.

6. Apparatus for converting a stream of partly overlapping sheets into a row of substantially fully overlapping sheets, comprising first conveyor means having a sheet supporting surface movable in a predetermined direction; second conveyor means defining a predetermined path for the transport of sheets which form said stream to said supporting surface whereby said sheets form a growing row which accumulates on and moves with said supporting surface in said direction; pusher means adjacent to said supporting surface and reciprocable in a path in and counter to said direction between spaced-apart first and second end positions to move the rearmost sheet of the growing row in said direction during movement to said first end position and to provide room for movement of the foremost sheet of said stream toward said supporting surface in said second end position, said pusher means extending forwardly of said path, as considered in said direction, in said first end position; means for reciprocating said pusher means between said end positions; and means for adapting the apparatus for handling sheets of differing qualities such as thickness, stiffness and surface finish, including means for so adjusting said reciprocating means as to change the location of said path, the extent, and the frequency, of reciprocation of said pusher means in dependence on the qualities of the sheets to be handled.

* * * * *